US010426304B2

(12) United States Patent
Betcher et al.

(10) Patent No.: US 10,426,304 B2
(45) Date of Patent: Oct. 1, 2019

(54) PORTABLE EXTRACTOR MACHINE

(71) Applicant: Hydramaster, LLC, Valrico, FL (US)

(72) Inventors: Scott Betcher, Burnsville, MN (US); Mark Baxter, Coeur d' Alene, ID (US); Steve Williams, Hayden Lake, ID (US)

(73) Assignee: Hydramaster, LLC, Valrico, FL (US)

( * ) Notice: Subject to any disclaimer, the term of this patent is extended or adjusted under 35 U.S.C. 154(b) by 697 days.

(21) Appl. No.: 13/672,519

(22) Filed: Nov. 8, 2012

(65) Prior Publication Data

US 2013/0111697 A1 May 9, 2013

Related U.S. Application Data

(60) Provisional application No. 61/557,164, filed on Nov. 8, 2011.

(51) Int. Cl.

| | |
|---|---|
| ***A47L 11/34*** | (2006.01) |
| ***A47L 11/40*** | (2006.01) |
| ***A47L 9/00*** | (2006.01) |

(52) U.S. Cl.

CPC ..... *A47L 9/00* (2013.01); *A47L 11/34* (2013.01); *A47L 11/4083* (2013.01); *A47L 11/4097* (2013.01)

(58) Field of Classification Search

CPC ..... A47L 9/00; A47L 11/34; A47L 11/4083; A47L 11/4097; A47L 11/4086

USPC ..... 15/320

See application file for complete search history.

(56) References Cited

U.S. PATENT DOCUMENTS

| | | | | | |
|---|---|---|---|---|---|
| 3,056,911 | A | * | 10/1962 | Hart et al. | 318/272 |
| 3,262,146 | A | * | 7/1966 | Hays | 15/321 |
| 4,533,370 | A | * | 8/1985 | Ikezaki et al. | 96/382 |
| 4,628,689 | A | * | 12/1986 | Jourdan | 60/295 |
| 4,786,299 | A | * | 11/1988 | DeMarco | 96/382 |
| 4,809,397 | A | * | 3/1989 | Jacobs | A47L 11/34 15/320 |
| 5,048,148 | A | * | 9/1991 | Gleadall | 15/321 |
| 5,289,612 | A | * | 3/1994 | Glenn, III | 15/326 |
| 5,502,869 | A | * | 4/1996 | Smith et al. | 15/326 |
| 5,513,417 | A | * | 5/1996 | Kim et al. | 15/326 |
| 5,657,509 | A | * | 8/1997 | Trautloff | A47L 11/34 15/321 |

(Continued)

OTHER PUBLICATIONS

"500 PSI Medium Duty Extractor", Sandia Products, [online]. [retrieved on Jun. 21, 2013]. Retrieved from the Internet: <URL: http://sandiaplastics.com/extractortwelve500.aspx>, (2013), 1 pg.

(Continued)

*Primary Examiner* — Joseph J Hail
*Assistant Examiner* — J Stephen Taylor

(57) ABSTRACT

A vacuum extraction apparatus comprises a base having a first end and a second end, a tank assembly having a first end and a second end, a fluid pump operable to draw fluid from a first tank of the tank assembly and distribute the fluid to a fluid port, a heating unit operable to control a temperature of the fluid, and one or more vacuum units operable to decrease a pressure level within a second tank of the tank assembly. The second end of the tank assembly is rotatably coupled to the second end of the base, thereby providing access to an internal chamber of the base.

20 Claims, 16 Drawing Sheets

(56) References Cited

U.S. PATENT DOCUMENTS

| | | | | |
|---|---|---|---|---|
| 6,031,969 | A * | 2/2000 | Burr | A47L 1/08 15/320 |
| 6,425,958 | B1 * | 7/2002 | Giddings | A47L 11/03 134/21 |
| 6,561,209 | B2 * | 5/2003 | Wojan et al. | 137/79 |
| 6,898,820 | B2 * | 5/2005 | Kasper | A47L 5/30 15/320 |
| 7,272,869 | B1 * | 9/2007 | Robinson | 15/320 |
| 7,624,474 | B1 * | 12/2009 | Cho | 15/320 |
| 8,032,979 | B2 * | 10/2011 | Boone | 15/321 |
| 2003/0041407 | A1 * | 3/2003 | Savage | 15/321 |
| 2005/0081898 | A1 * | 4/2005 | Williams et al. | 134/172 |
| 2006/0117517 | A1 * | 6/2006 | Michael | A47L 7/0009 15/320 |
| 2008/0098560 | A1 * | 5/2008 | Williams et al. | 15/320 |
| 2010/0101042 | A1 * | 4/2010 | Williams | 15/320 |

OTHER PUBLICATIONS

"Clarke® Clean Track® 16 18 Instructions for Use and Parts List", Form No. 56041660 Dec. 2006 revised Dec. 2008, (2008), 80 pgs.
"Clarke® Image 16 I/IX 120V Wash&Rinsee ErgoEX®", Form No. 70670A Dec. 2005, (Dec. 2005), 60 pgs.
"HHP-300 Extractor 120V: Information & Operating Instructions", U.S. Products, (Jun. 2010), 8 pgs.
"KaiVac® 1700 Operator and Parts Manual", © 2006 Kaivac, Inc., (2006), 31 pgs.
"KaiVac® 1700 Series", © 2009 Kaivac, Inc., (2009), 1 pg.
"Ninja Warrior 500 PSI", (Aug. 14, 2009), 50 pgs.
"Olympus M100 Operating Manural", © 2005 Hydro-Force, (2005), pp. 1, 23, and 40.
"Sandia Products—Sniper 12-Gallon Extractors", [online]. [archived on Jul. 12, 2012]. Retrieved from the Internet: <URL: https://web.archive.org/web/20120712015146/http://sandiaplastics.com/sellSheets.aspx>, (2012), 2 pgs.
"Sandia Products—The Optimizer Extractor", [online]. [archived May 12, 2013]. Retrieved from the Internet: <URL: https://web.archive.org/web/20130512225141/http://sandiaplastics.com/PDF/extractorOptimizer_sellsheet.pdf>, (2013), 2 pgs.
"Scooter the Beast", Namco, [online]. [retrieved on Jun. 26, 2009]. Retrieved from the Internet: <URL: https://web.archive.org/web/20090626002951/http:/www.namcomfg.com/namco3/shop/item.asp?itemid=477>, (2009), 2 pgs.
"Scooter the Beast", Namco, [online]. [retrieved on Mar. 19, 2010]. Retrieved from the Internet: <URL: http://www.namcomfg.com/namco3/shop/item.asp?itemid=477>, (2010), 2 pgs.
"The Kaivac® 1750 Equipment Specifications", © 2009 Kaivac, Inc., (2009), 1 pg.
"U. S. Products King Cobra® 500 120V", Apr. 2010, (2010), 8 pgs.
"U.S. Products Advantage—400H Extractor 120V", Feb. 2010 revised Nov. 2011 Form No. 56041940, (2010), 14 pgs.
"U.S. Products Agitator 16, Agitator 18, Clean and Restore: Instructions for use and parts list", (Jun. 2013 (revised)), 19 pgs.
"U.S. Products Solus® 500", Jun. 2007 revised Jul. 2012 Form No. 56041969, (Jun. 2007), 44 pgs.
"Windsor® Dominator Operating Instructions", 86328170-E, (Jun. 29, 2010), 51 pgs.

* cited by examiner

PORTABLE EXTRACTOR MACHINE

CROSS REFERENCE TO RELATED APPLICATIONS

This application claims the benefit of priority of U.S. Provisional Application No. 61/557,164, filed on Nov. 8, 2011, under 35 U.S.C. § 119(e), which is hereby incorporated by reference in its entirety.

BACKGROUND

The present patent application relates to carpet cleaning equipment, and, more particularly, to a portable vacuum extractor machine for cleaning carpets and other fabrics.

Cleaning carpet, upholstery, tile floors, and other surfaces enhances the appearance and extends the life of such surfaces by removing the soil embedded in the surface. Moreover, carpet cleaning removes allergens, such as mold, mildew, pollen, pet dander, dust mites, and bacteria. Indeed, regular cleaning keeps allergen levels low and thus contributes to an effective allergy avoidance program.

Vacuum extractors for cleaning surfaces, such as carpet, typically deposit a cleaning fluid upon the carpet or other surface to be cleaned. The deposited fluid, along with soil entrained in the fluid, is subsequently removed by high vacuum suction. This enables the carpet to be completely dry before mold has time to grow. The soiled fluid, i.e., waste fluid, is then separated from the working air and is collected in a recovery tank.

Due to the prevalence of carpeted surfaces in commercial establishments, institutions, and residences, there exists a thriving commercial carpet cleaning industry. In order to maximize the efficacy of the cleaning process, commercial vacuum extractors should be powerful to minimize the time in which the soil entrained cleaning fluid is present in the carpet. Commercial vacuum extractors should also be durable. That is, such a vacuum extractor should be manufactured from durable working parts so that the extractor has a long working life and requires little maintenance. Unfortunately, the cost of a high powered and durable machine can rise significantly if not designed cost effectively.

Individuals working in the carpet cleaning industry are subject to the undesirably loud noise produced by the vacuum motors of conventional vacuum extractors. In addition, some conventional vacuum extractors include fans mounted near internally housed pumps, vacuum motors, and pre-heaters. The fans function to expel air that has been heated by the internal mechanisms from the housing in which they are positioned. Unfortunately, the fans further contribute to the noise produced by conventional vacuum extractors. Fans also add expense and complexity, as well as increase power consumption.

Commercial extractors are often transported in a vehicle from one location to another. Consequently, ease of portability is an important consideration. Furthermore, because space is typically limited in the transport vehicle, minimizing the "footprint" of the extractor is also an important consideration. With regard to extractors that are stored in a janitor closet as opposed to a transport vehicle, minimizing the footprint remains an important consideration because closet space is generally limited in a commercial setting.

Additionally, conventional extractors generally include a single temperature setting for heating the cleaning fluid. However, it may be desirable to have at least a high temperature setting and a low temperature setting that may be selected depending upon the particular application. For example, the low temperature setting may be desirable for upholstery and other delicate fibers, while the high temperature setting may be desirable for synthetic carpets or the like.

Accordingly, what is needed is an apparatus for cleaning a surface that is cost effectively designed while being both high powered and durable. In addition, what is needed is a vacuum extractor in which the noise produced by the vacuum motors is sufficiently muffled.

OVERVIEW

This overview is intended to provide an overview of subject matter of the present patent application. It is not intended to provide an exclusive or exhaustive explanation of the invention. The detailed description is included to provide further information about the present patent application.

The present inventors have recognized, among other things, that use of a dual bi-metal thermostat in a portable extraction apparatus can provide a simple yet effective means for maintaining the temperature of a cleaning fluid within a desired range. The present inventors have also recognized that improved access to the components of a vacuum extraction apparatus can be provided by pivotally coupling a tank assembly about a bottom of a vacuum extraction apparatus base member. Further, improved cooling systems and muffler systems for a vacuum extraction apparatus have been discovered and are described herein.

In an example, a vacuum extraction apparatus is provided that includes a base having an upper end and a lower end vertically spaced from the upper end, a tank assembly coupled to the base and having an upper end and a lower end vertically spaced from the upper end, at least two transport wheels coupled to the lower end of the base, a fluid pump coupled to the base and operable to draw fluid from a first tank of the tank assembly and distribute the fluid to a fluid port, and one or more vacuum units coupled to the base and operable to decrease a pressure level within a second tank of the tank assembly. The vacuum extraction apparatus can be designed such that at least a portion of the fluid pump is vertically spaced from the one or more vacuum units within a base chamber when the vacuum extraction apparatus is in a generally vertical operational position. In an example, the vacuum extraction apparatus can further include a heating unit operable to elevate a temperature of the fluid, wherein the heating unit comprises one or more discrete temperature settings.

In an example, a vacuum extraction apparatus is provided that includes a base, a tank assembly coupled to the base, a fluid pump operable to draw fluid from a first tank of the tank assembly and distribute the fluid to a fluid port, a heating unit operable to elevate a temperature of the fluid, one or more vacuum units operable to decrease a pressure level within a second tank of the tank assembly, and an exhaust chamber positioned adjacent to a bottom side of the base and configured to receive exhaust air from the one or more vacuum units. The exhaust chamber can include a series of substantially parallel and substantially perpendicular walls defining a generally serpentine path for the exhaust air.

In an example, a vacuum extraction apparatus is provided that includes a base, a tank assembly coupled to the base and including a first tank and a second tank, a fluid pump operable to draw fluid from the first tank and distribute the fluid to a fluid port, a heating unit operable to heat the fluid to a selectable temperature, a vacuum system including a first vacuum unit and a second vacuum unit, and an exhaust chamber configured to receive exhaust air from the vacuum system. The heating unit can include at least a first thermostat device for substantially maintaining the fluid at a first temperature and a second thermostat device for substantially maintaining the fluid at a second temperature. The first and second vacuum units can be configured to be individually or simultaneously operated to provide at least two distinct pressure levels within the second tank.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present patent application relates to portable extractor machines for cleaning carpet, various fabrics, and other surfaces.

Figure 1:
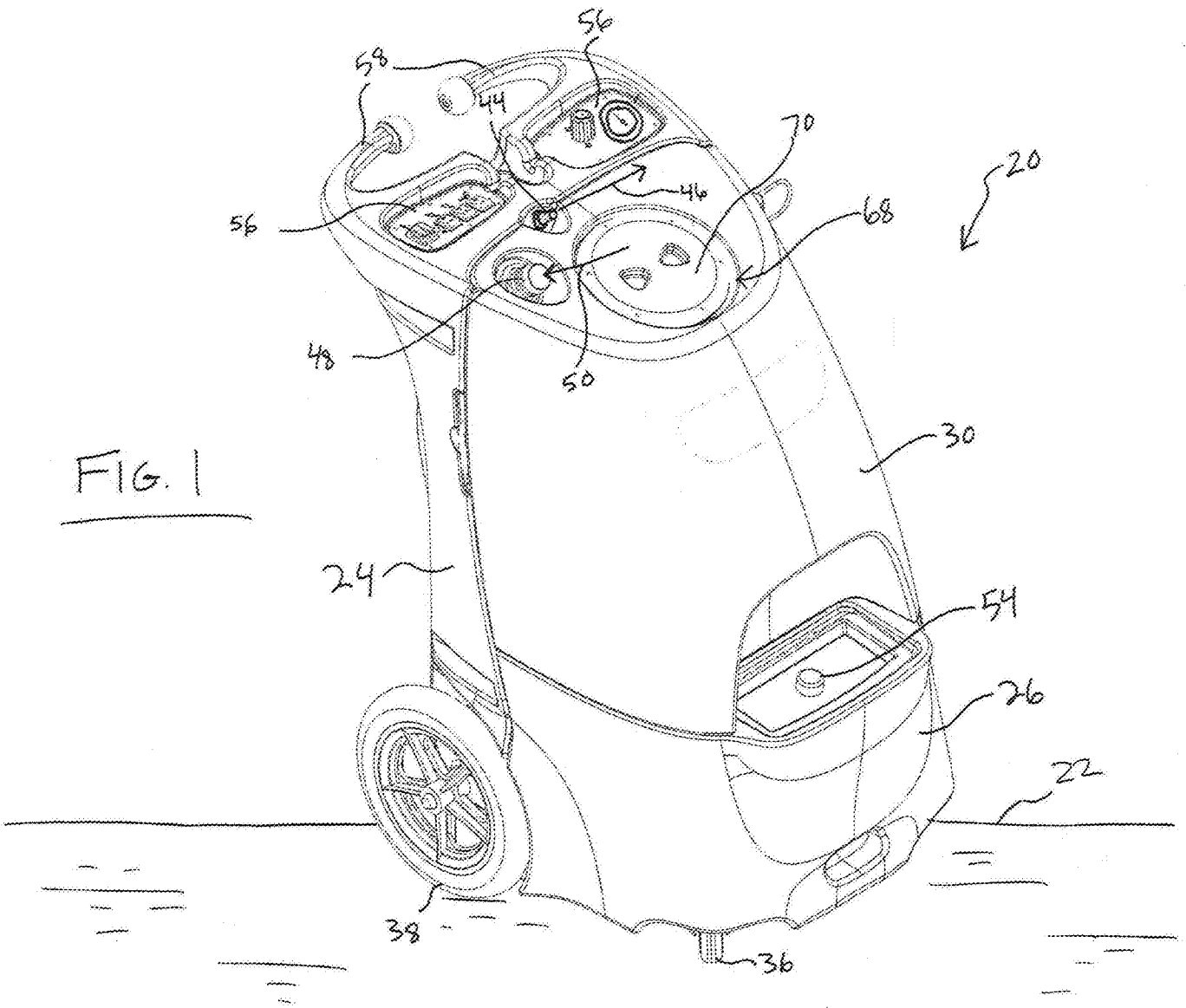
FIG. 1 is a front perspective view of a vacuum extraction apparatus for cleaning a surface in accordance with an example of the present application
Figure 2:
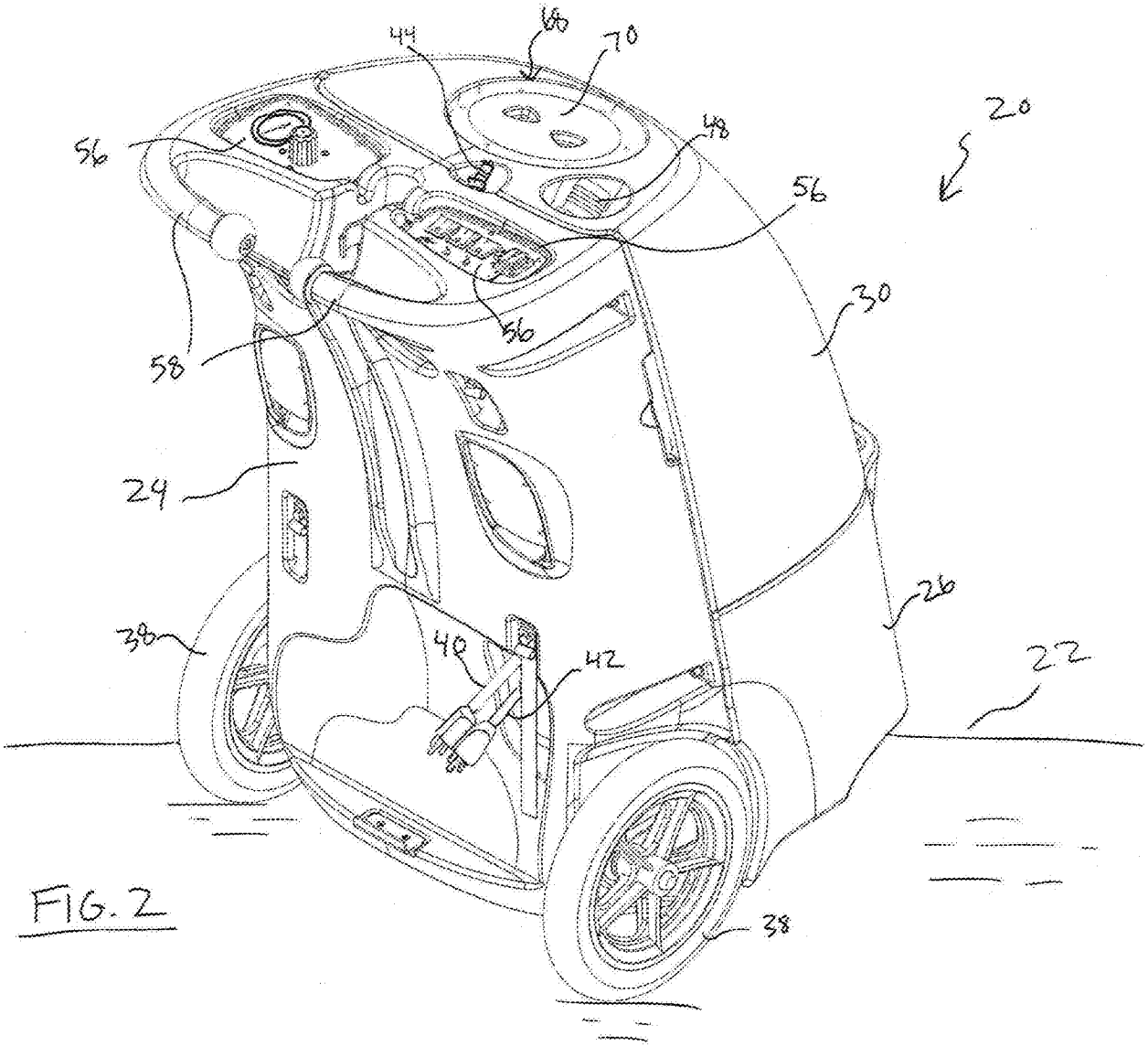
FIG. 2 is a rear perspective view of the vacuum extraction apparatus.
Figure 3:
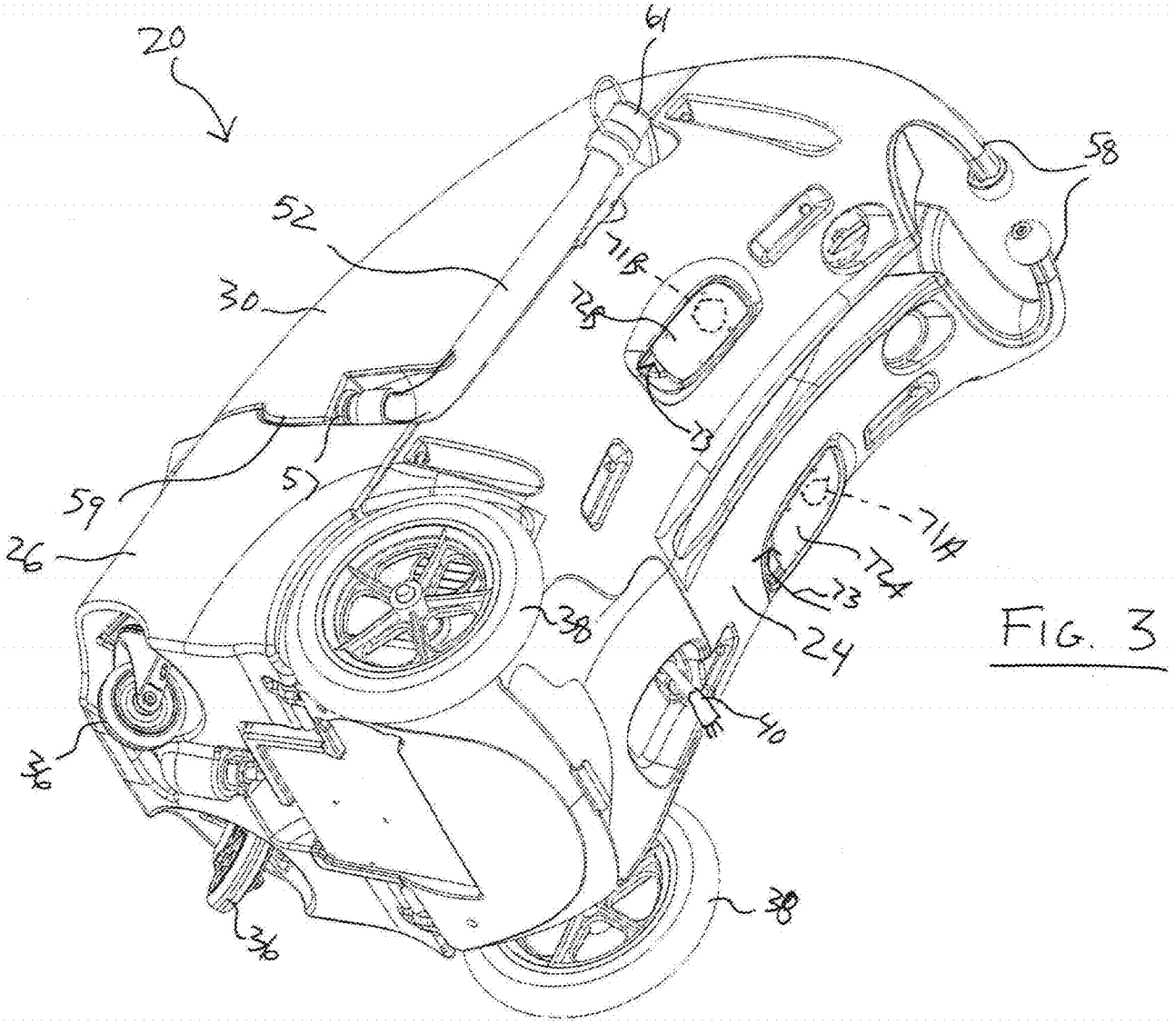
FIG. 3 is a bottom perspective view of the vacuum extraction apparatus.

Referring to FIGS. 1-3, FIG. 1 shows a front perspective view of a vacuum extraction apparatus 20 for cleaning a surface 22 in accordance with an example of the present application. FIG. 2 shows a rear perspective view of the vacuum extraction apparatus 20, and FIG. 3 shows a bottom perspective view of the vacuum extraction apparatus 20. The vacuum extraction apparatus 20 of FIGS. 1-3 is configured as an upright clam-shell type carpet cleaner/extractor, and can be utilized in both residential and commercial cleaning applications. In general, the vacuum extraction apparatus 20 can include a base 24, a lower first tank 26 pivotally coupled to the base 24 via a hinge 28 (FIG. 4), and an upper second tank 30 coupled to the first tank 26.

The base 24 can include one or more caster-type front wheels 36 and larger rear wheels 38 for ease of maneuverability. However, the front wheels 36 can be omitted without departing from the intended scope of the present application. As discussed in further detail below, internal fluid delivery, heating, and extraction components can be housed in the base 24. A first electrical cord 40 and a second electrical cord 42 can extend into the base 24 to power the internal components. However, with reference to extractors having a smaller number of internal components, such as a single vacuum unit (as opposed to two vacuum units as will be described herein), only one electrical cord may be required. The base 24 can further include a fluid delivery port 44 from which a cleaning fluid 46, represented by an arrow in FIG. 1, can be provided to a cleaning wand (not shown).

The first tank 26 can be adapted to contain the cleaning fluid 46. Thus, the first tank 26 is hereinafter referred to as the clean fluid tank 26. The cleaning fluid 46 can be water or any suitable cleaning solution. The second tank 30 can include an inlet 48 to which a vacuum hose of the cleaning wand couples. The second tank 30 is configured to receive a mixture of soiled cleaning fluid and air, represented by an arrow 50, at the inlet 48. Thus, the second tank 30 is hereinafter referred to as the recovery tank 30. The recovery tank 30 can subsequently be emptied via a drain hose 52.

In an example, the base 24, the clean fluid tank 26, and the recovery tank 30 can be formed from a durable plastic material, such as polyethylene. An exemplary manufacturing method for the base 24, the clean fluid tank 26, and the recovery tank 30 is rotational molding. Rotational molding, also known as rotational casting, is a method for molding hollow plastic objects by placing finely divided particles in a hollow mold that is rotated about two axes, exposing it to heat and then to cold. A rotational molding technique and polyethylene can be a desirable combination due to their cost effectiveness. However, those skilled in the art will appreciate that other manufacturing methodologies, such as blow molding, can be employed. Further, numerous other materials can be used in place of polyethylene.

In an example, the clean fluid tank 26 can include a fill port 54 which can be used to fill the clean fluid tank 26 with the cleaning fluid 46. A control panel 56 can be positioned on a top portion of the base 24. The control panel 56 can include one or more switches, buttons, dials, gauges, or the like for operating the internal components located in the base 24. Exemplary switches, buttons, dials, or gauges of the control panel 56 can include a fluid pressure dial, vacuum motor switches, heating element switches, and the like. The base 24 can further include handles 58 that can be utilized by the operator to maneuver the apparatus 20. In an example, the handles 58 can be roller handles to assist with loading, unloading, and stair climbing.

With reference to FIG. 3, in an example an inlet 57 of the drain hose 52 can be fluidly coupled to a trough 59 formed at the bottom of the recovery tank 30. Providing a trough 59 can create a low-point where the waste fluid can be collected and drained through the drain hose 52. A cap 61 on an outlet of the drain hose 52 can seal the hose during operation of the vacuum extraction apparatus 20. With further reference to FIGS. 1 and 2, the recovery tank 30 can include an opening 68 on a top side which can also be used to clean out any excess waste fluid in the recovery tank 30 that does not drain through the drain hose 52. A screw-on lid 70 located in opening 68 can be provided to enclose the interior of the recovery tank 30 from the surrounding environment.

Optionally, the recovery tank 30 can include internally or externally molded rib members (not shown) generally encircling the recovery tank 30. Because the recovery tank 30 is sealed from the surrounding environment, it is subject to significant vacuum from the vacuum motors (discussed below) of the vacuum extraction apparatus 20. The inclusion of rib members can provide strength to the recovery tank 30 so as to avoid tank collapse when placed under a vacuum.

With reference again to FIG. 3, a rear side of the base 24 can include one or more air intakes that are fluidly coupled to one or more vacuum units housed within the base 24 for providing a source of cooling air for the vacuum units, such as first and second air intakes 71A and 71B. The cooling operation is discussed in further detail below. First and second intake covers 72A and 72B can be coupled over the respective first and second air intakes 71A and 71B such that air is not drawn directly into the air intakes, but instead is drawn indirectly therein as illustrated by the arrows 73. As appreciated by those skilled in the art, providing intake covers 72A and 72B can minimize the risk of debris or fluid being drawn into the air intakes 71A and 71B. Furthermore, the positioning of the first and second air intakes 71A and 71B vertically spaced from the floor surface allows cooler, drier air to be drawn in and used to cool the vacuum units, as opposed to the hotter, most air found closer to the floor surface.

Figure 4:
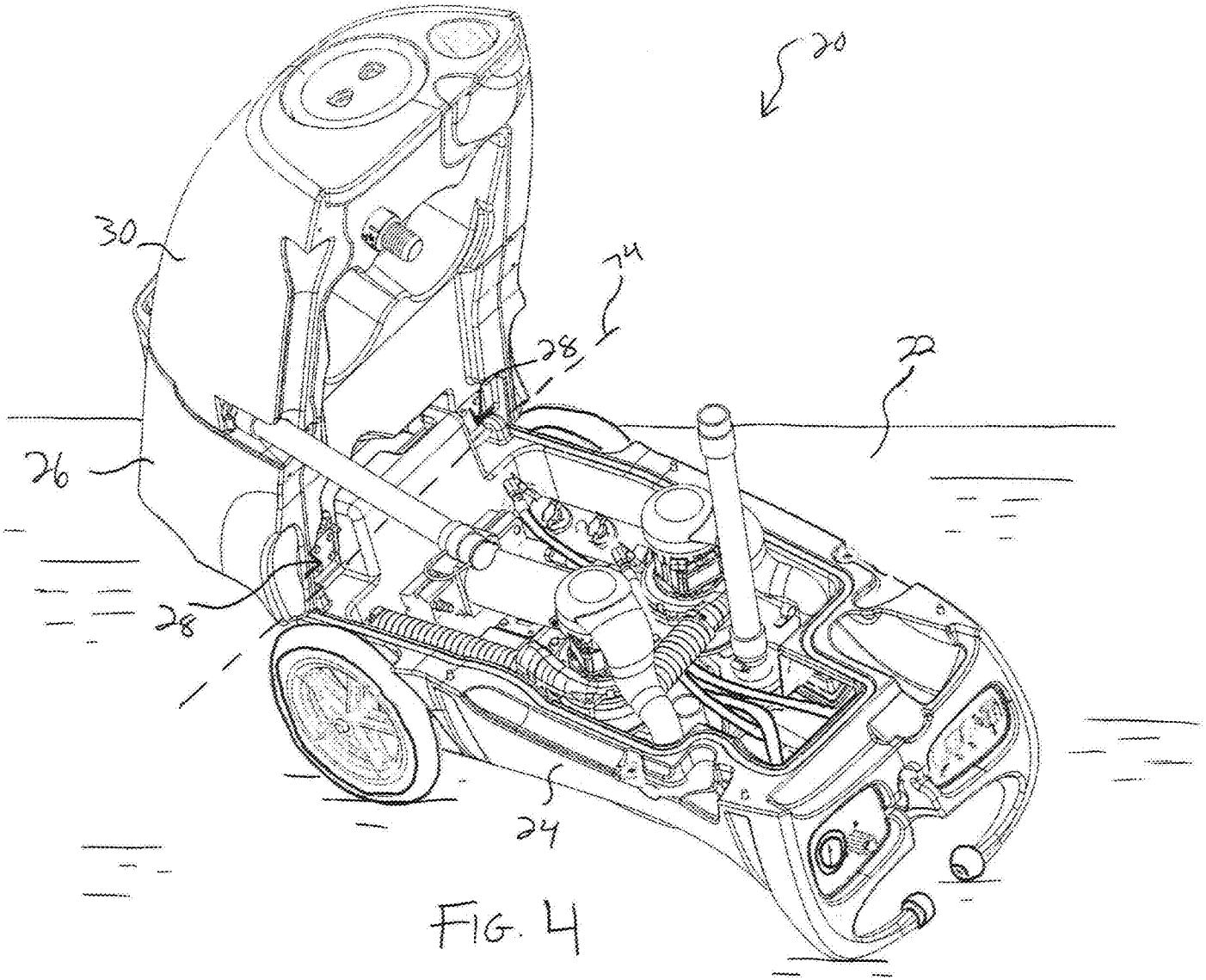
FIG. 4 is a perspective view of the vacuum extraction apparatus with a clean fluid tank and a recovery tank in a rotated, open position.

FIG. 4 is a perspective view of the vacuum extraction apparatus 20 with the clean fluid tank 26 and the recovery tank 30 rotated about a pivot axis 74 to an open position, via the hinge 28, thereby providing access to the internal compartment of the base 24. In an example, the hinge 28 can comprise one or more axle rods about which the clean fluid tank 26 can rotate. Further, the clean fluid tank 26 and/or the recovery tank 30 can be tethered (not shown) to the base 24 to limit the extent to which the tanks can rotate relative to the base 24.

As further illustrated in FIG. 4, the design of the vacuum extraction apparatus 20 can allow the base 24 to be positioned substantially flat on the surface 22 such that the clean fluid tank 26 and recovery tank 30 can be lifted in a generally upward direction. As a result, improved access to the various components within the base 24 can be provided.

Figure 5A:
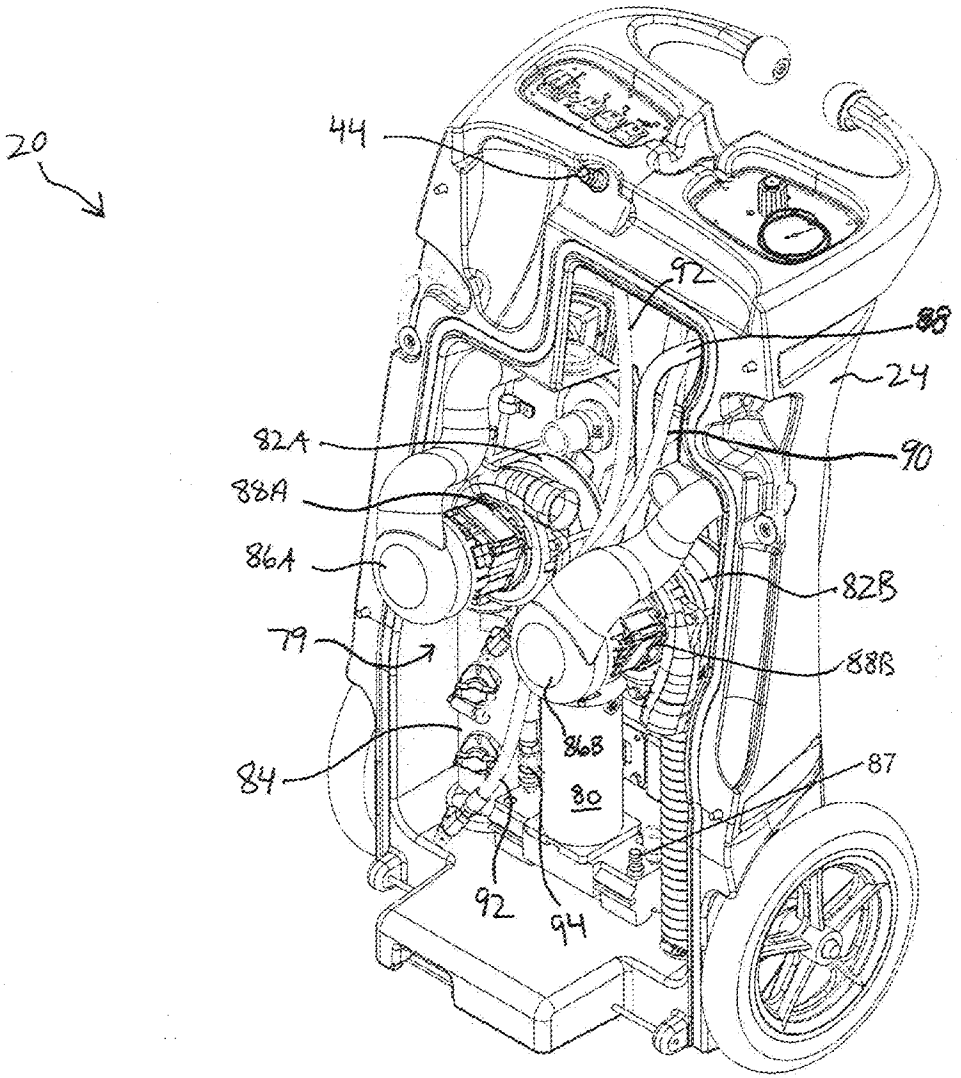
FIG. 5A is a front perspective view of the vacuum extraction apparatus with the clean fluid tank and the recovery tank removed to illustrate the internal components mounted within a base chamber of the vacuum extraction apparatus.

FIG. 5A is a front perspective view of the vacuum extraction apparatus 20 with the clean fluid tank 26 and the recovery tank 30 removed to illustrate the internal components mounted in a chamber 79 of the base 24. In an example, the vacuum extraction apparatus 20 can include a pump 80, a first vacuum unit 82A, a second vacuum unit 82B, and a heating unit 84 mounted within the base 24. A first vacuum motor intake 86A can be coupled between a top end of the first vacuum unit 82A and the first air intake 71A, and a second vacuum motor intake 86B can be coupled between a top end of the second vacuum unit 82B and the second air intake 71B. In operation, air can be drawn through the first and second air intakes 71A and 71B and directed into the first and second vacuum units 82A and 82B via the first and second vacuum motor intakes 86A and 86B in order to cool one or more components of the vacuum units, such as windings and brushes of a vacuum motor. The cooling air exhaust can be directed into the chamber 79 of the base 24 through respective exhaust outlets 88A and 88B.

Figure 5B:
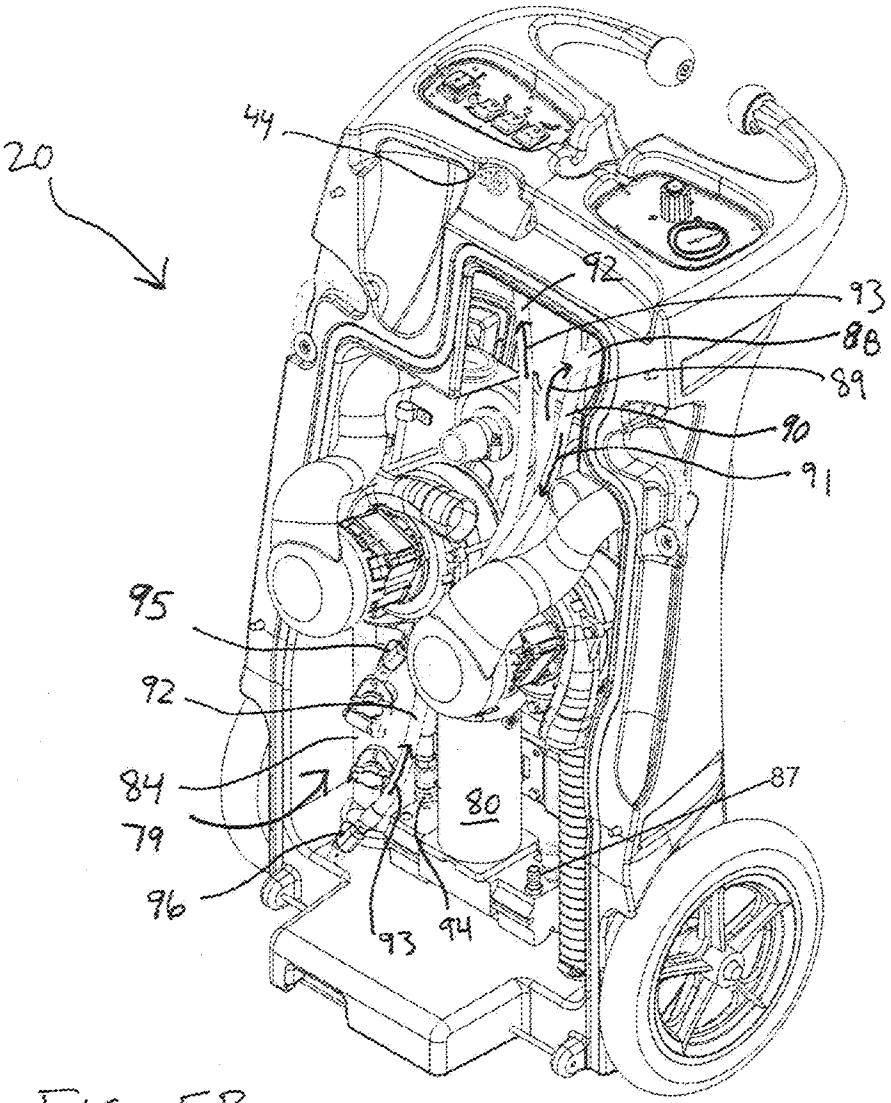
FIG. 5B is a perspective view of the vacuum extraction apparatus illustrating a flow of cleaning fluid through the vacuum extraction apparatus.

In an example, the cleaning fluid 46 can be delivered to the fluid delivery port 44 via the pump 80 and a series of hoses, including a first hose 88, a second hose 90, and a third hose 92. FIG. 5B is a perspective view of the vacuum extraction apparatus 20 illustrating the flow of cleaning fluid 46 to the fluid delivery port 44. In operation, the cleaning fluid 46 is drawn into the pump 80 from the clean fluid tank 26 through a pump inlet 87. The cleaning fluid 46 can then be pressurized within the pump 80 and routed out of a pump outlet 94 and through the first hose 88 in the direction indicated by arrow 89 towards a top of the chamber 79. The first hose 88 can be operably coupled to a pressure unloader mechanism (not shown), which can be configured to hold the pressure of the cleaning fluid 46 at a desired level selected by the operator. However, any suitable adjustable pressure regulator device can also be used in place of the pressure unloader without departing from the intended scope of the present application. In an example, the operator can select a pressure between about 50 psi and about 500 psi, although other pressure ranges are also possible. Particularly, the pressure unloader mechanism can be configured to unload pressure off the pump head and hold the pressure of the cleaning fluid 46 in the second hose 90 between the pressure unloader mechanism and the heating unit 84 at the desired pressure level.

The pressurized cleaning fluid 46 can then be routed towards the heating unit 84 in the direction indicated by arrow 91. An outlet of the second hose 90 can be coupled to an inlet 95 of the heating unit 84 with a suitable connection. The cleaning fluid 46 can then be passed through the heating unit 80 and heated to a desired temperature selected by the operator. Subsequently, the heated cleaning fluid 46 can be routed out of the heating unit 84 through an outlet 96 coupled to the third hose 92. The third hose 92 can be configured to carry the heated cleaning fluid 46 towards a top of the chamber 79 in the direction indicated by arrow 93, where it couples with the fluid delivery port 44 for distribution through the cleaning wand.

Figure 5C:
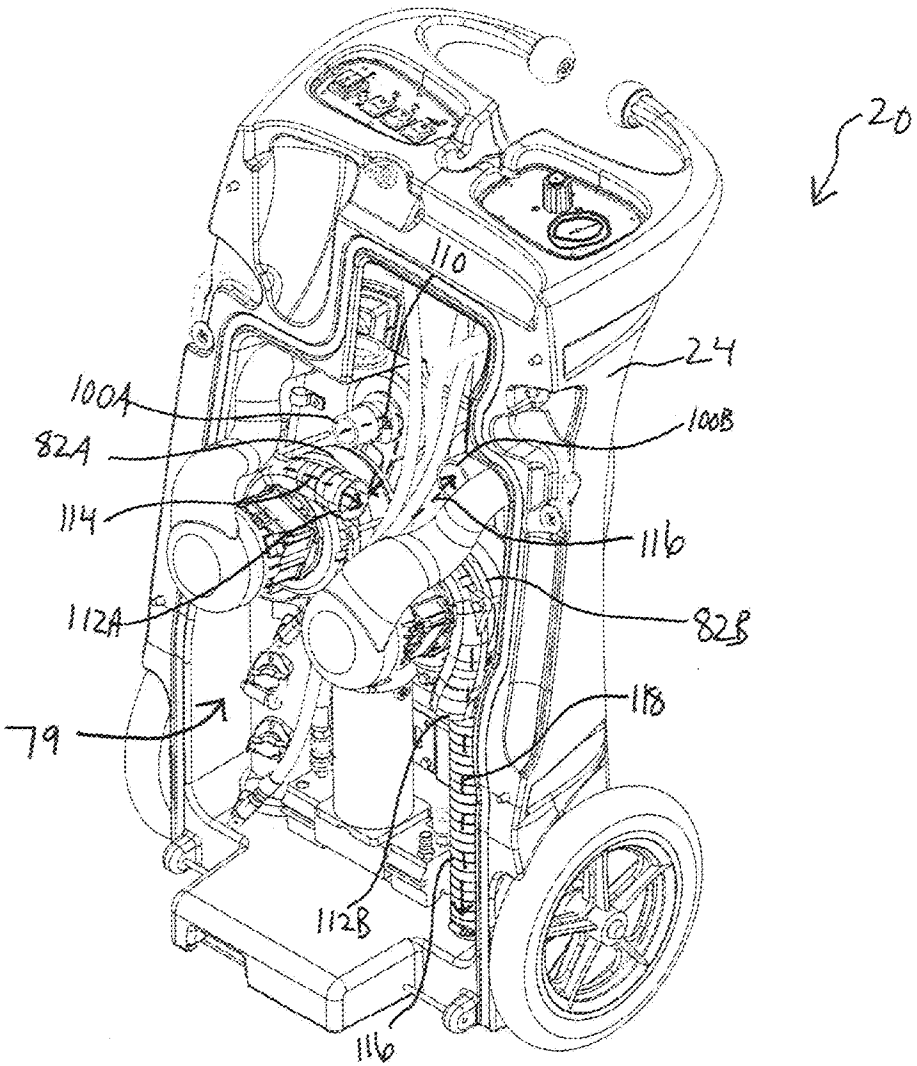
FIG. 5C is a perspective view of the vacuum extraction apparatus illustrating operation of first and second vacuum units.

FIG. 5C is a perspective view of the vacuum extraction apparatus 20 illustrating flow through the vacuum system, including the first vacuum unit 82A and the second vacuum unit 82B. Initially, in an example the operator can select to energize the first vacuum unit 82A and/or the second vacuum unit 82B depending on the amount of vacuum suction that is desirable for the particular application. For example, the operator can select and energize the first vacuum unit 82A or the second vacuum unit 82B when cleaning a delicate fabric, such as drapery. When cleaning a surface such as carpet, the operator can choose to energize both the first vacuum unit 82A and the second vacuum unit 82B for increased extraction power. For purposes of discussion only, the following description assumes that both the first vacuum unit 82A and the second vacuum unit 82B are selected and energized.

Figure 6A:
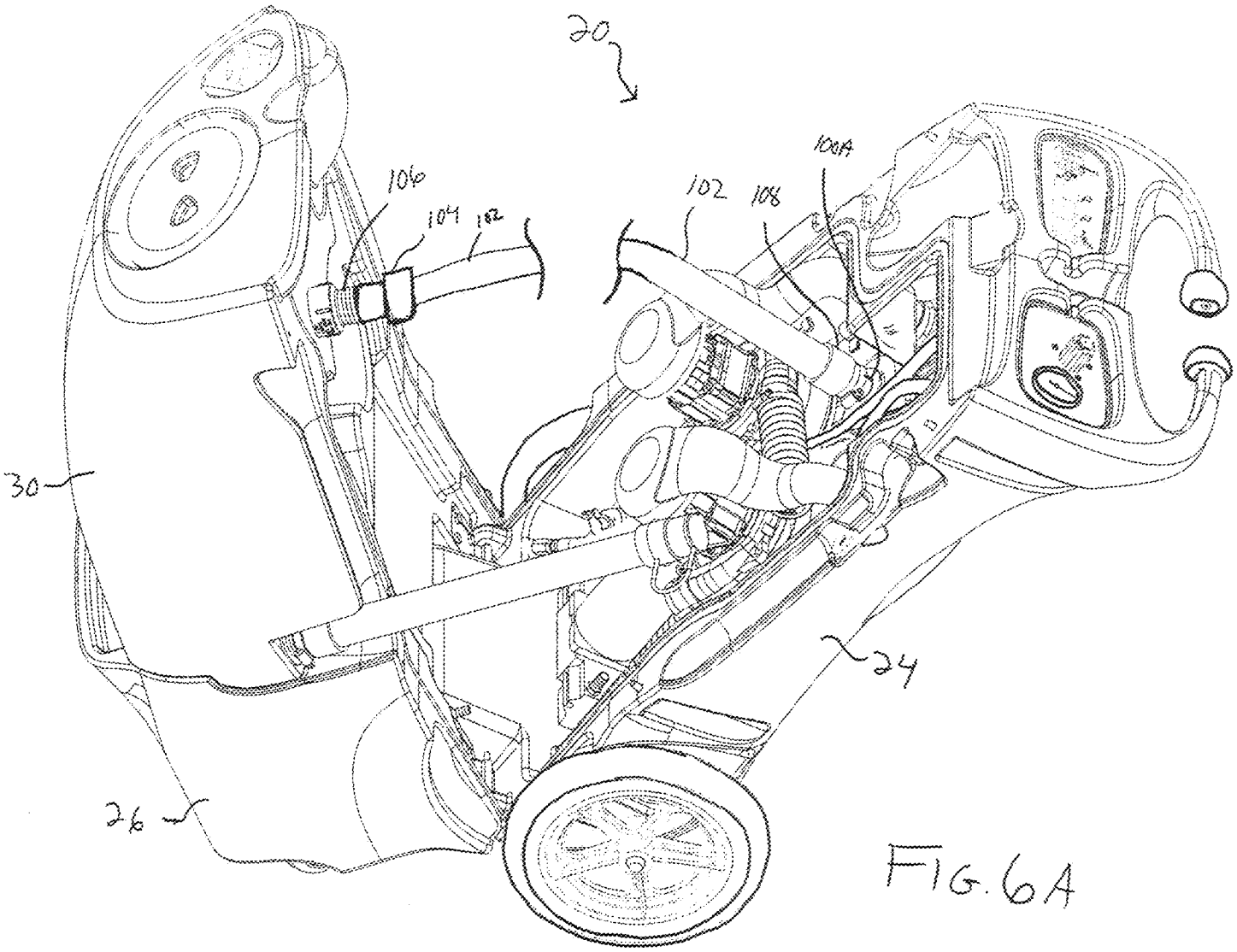
FIG. 6A is a perspective view of the vacuum extraction apparatus illustrating the coupling between the recovery tank and a first vacuum unit.
Figure 6B:
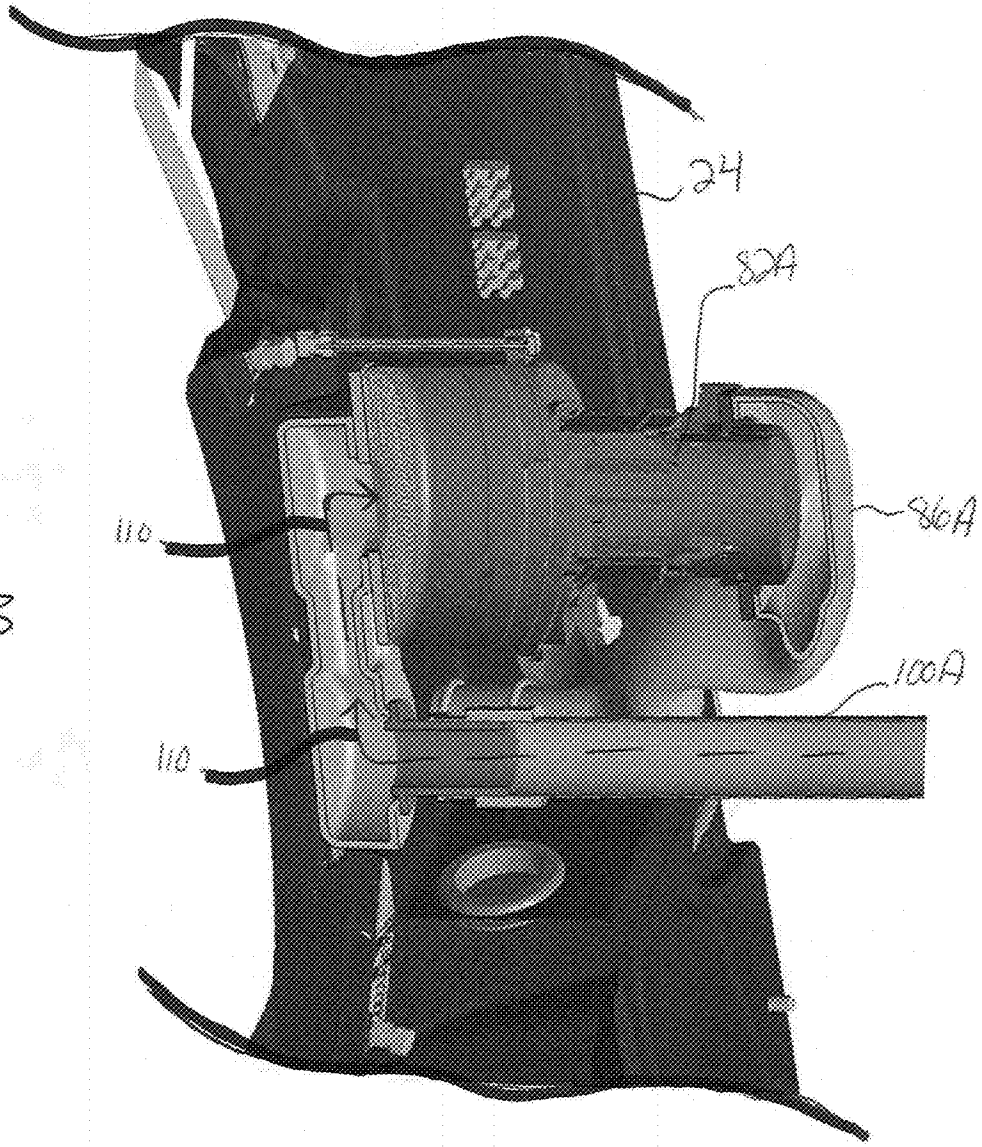
FIG. 6B is a diagram illustrating the flow of air from the recovery tank into the first vacuum unit.

In operation, an outlet of the recovery tank 30 can be coupled to a first vacuum hose connection 100A in the base 24. Particularly, FIG. 6A is a perspective view of the vacuum extraction apparatus 20 with the clean fluid tank 26 and the recovery tank 30 in a partially open position illustrating a rear side of the recovery tank 30. As shown in FIG. 6A, a vacuum hose 102 can be coupled at a first end 104 to a recovery tank outlet 106 and at a second end 108 to the vacuum hose connection 100A. With reference again to FIG. 5C, air can be drawn from within the recovery tank 30 where it can subsequently be directed into an opening in the bottom end of the first vacuum unit 82A as indicated by arrow 110. The path of the air through the vacuum hose connection 100A and into the bottom end of the first vacuum unit 82A is further illustrated in FIG. 6B. Drawing air from within the recovery tank 30 results in a decreased pressure level within the recovery tank 30, thereby allowing soiled cleaning fluid and air to be suctioned through the cleaning wand. With further reference to FIG. 5C, the air is passed through the first vacuum unit 82A and is directed out of the unit through a first vacuum unit outlet 112A as indicated by arrow 114. The vacuum unit outlet 112A can be coupled to a second vacuum hose connection 100B in the base 24 via a vacuum unit connection hose (not shown). The air can then be directed through the second vacuum hose connection 100B and into an opening in the bottom end of the second vacuum unit 82B as indicated by arrow 116. The second vacuum unit 82B draws the air through the unit and exhausts the air through a second vacuum unit outlet 112B and into an exhaust hose 116, as indicated by arrow 118, towards a bottom of the base 24. As discussed in further detail below, the exhaust hose 116 can be coupled to an exhaust chamber for dampening the noise and directing the exhaust air towards a carpet or other floor surface.

Figure 7A:
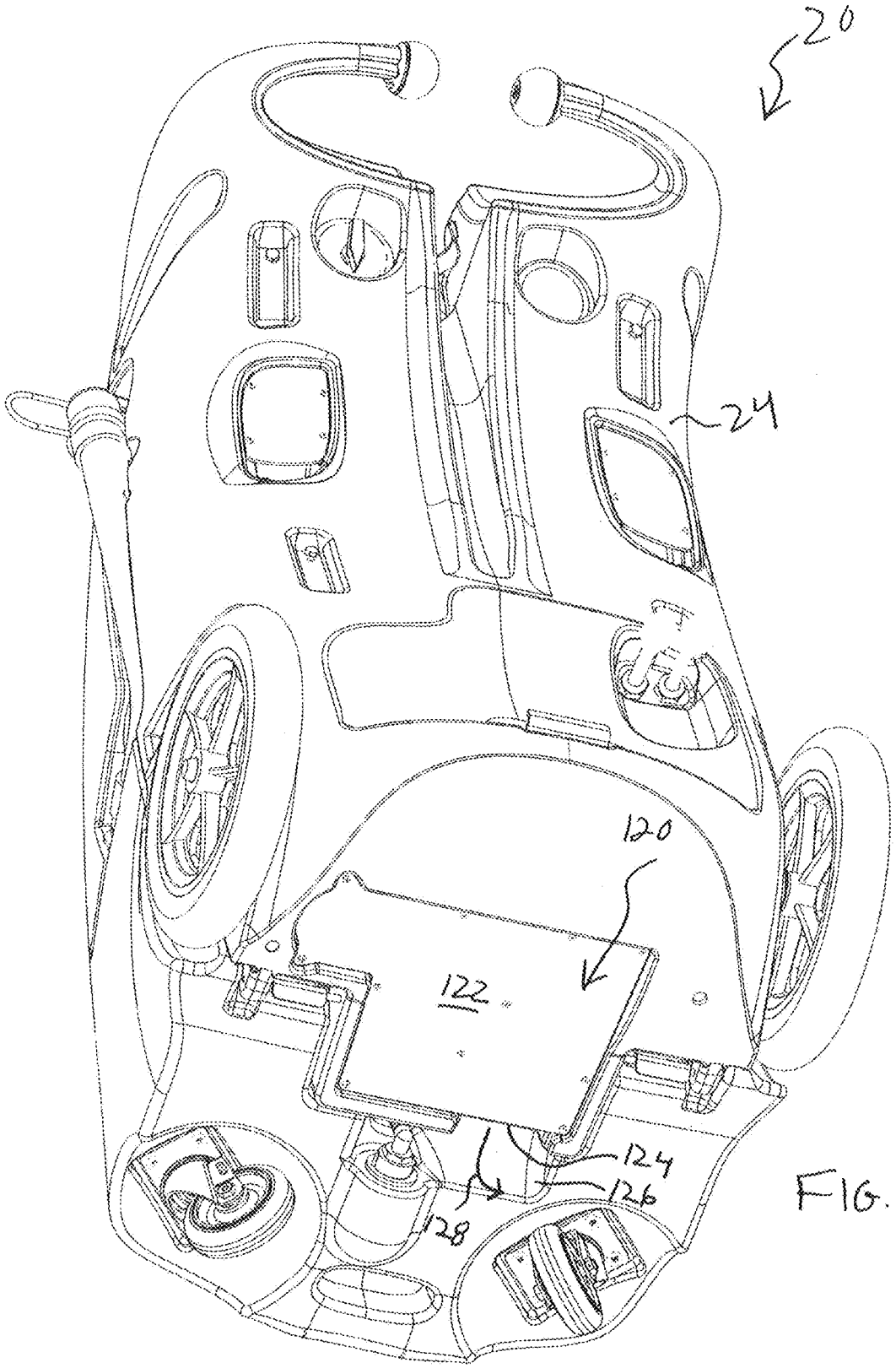
FIGS. 7A and 7B are bottom perspective views of the vacuum extraction apparatus illustrating an example of a muffler system.
Figure 7B:
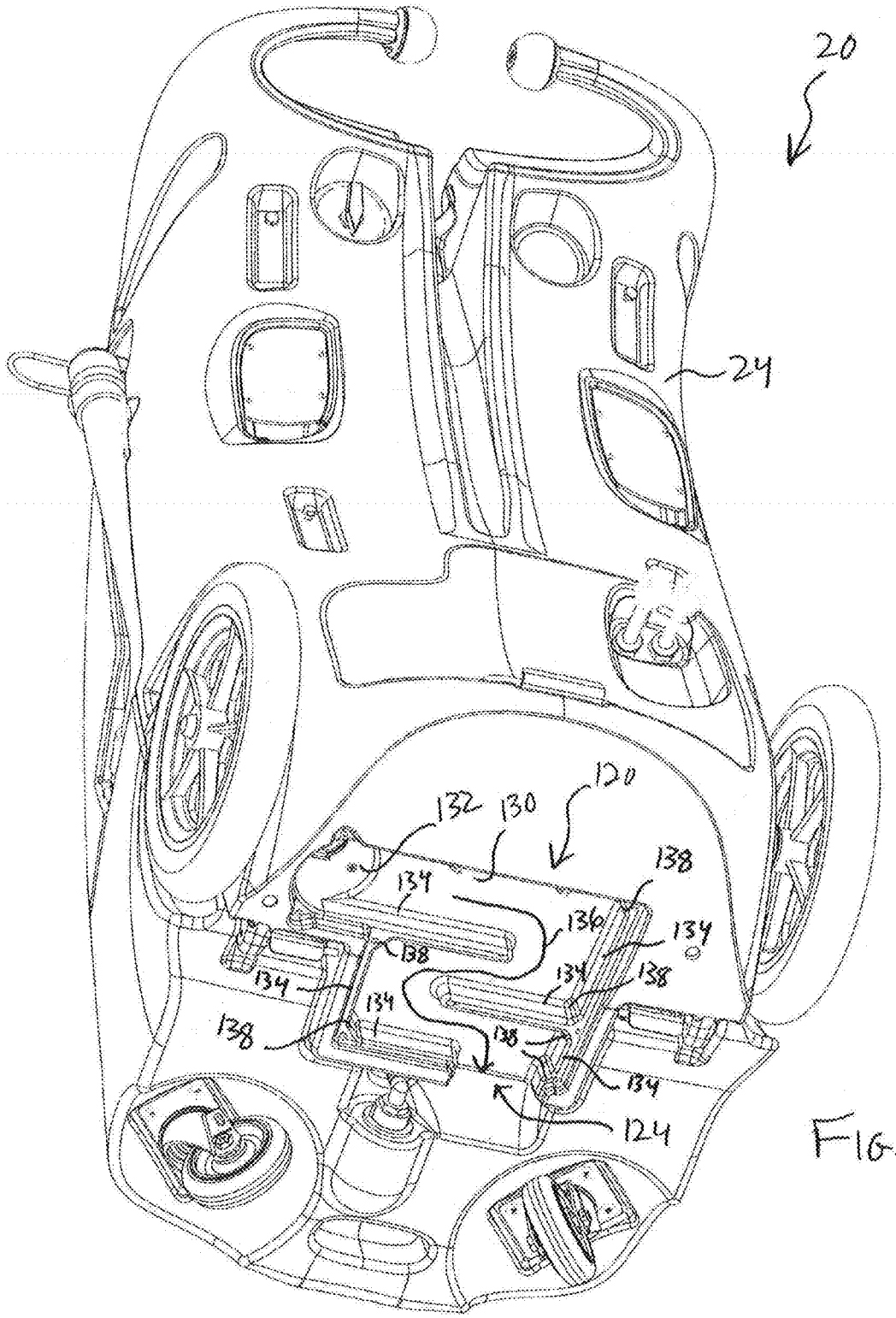

FIGS. 7A and 7B are bottom perspective views of the vacuum extraction apparatus 20 illustrating an example of a muffler system 120. With reference to FIG. 7A, in an example the muffler system 120 can include an exhaust chamber cover 122 enclosing an exhaust chamber (discussed with reference to FIG. 7B). The exhaust chamber cover 122 can be designed to provide an exterior barrier for the exhaust chamber and to direct the exhaust air from the first vacuum unit 82A and the second vacuum unit 82B through an exhaust chamber outlet 124. As illustrated in FIG. 7A, a bottom surface of the base 24 can include a curved, recessed chamber 126 configured to direct the exhaust air in a downward direction towards the carpet or other floor surface as indicated by arrow 128. In an example, directing the exhaust air into the carpet can help dampen the vacuum exhaust noise while keeping the exhaust air away from the first and second air intakes 71A and 71B at the rear of the vacuum extraction apparatus 20.

Turning next to FIG. 7B, the exhaust chamber cover 122 has been removed to reveal an exhaust chamber 130. The exhaust chamber 130 can be formed as an integral part of the base 24, or can be formed as a separate component that is attachable to the base 24 with a suitable fastening means such as screws, bolts, an adhesive, or the like. In an example, the exhaust chamber 130 can include an exhaust chamber inlet 132 operably coupled to the exhaust hose 116 (FIG. 5C) to receive the vacuum exhaust air. As illustrated in FIG. 7B, the exhaust chamber 130 can include internal walls 134 defining a generally serpentine path 136 for dampening the noise from the vacuum exhaust. The path formed by the internal walls 134 is described as a "serpentine" path merely for purposes of example and not limitation. Any path configuration that provides at least one change in direction of the vacuum exhaust can be utilized, such as a "zig-zag" or "spiral" configuration.

In an example, the serpentine path 136 can be defined by a series of substantially parallel and perpendicular walls 134 representing a "squared-off" path design. However, "curved" path designs defined by a series of curved or rounded walls are also contemplated. In a further example, the intersections of the substantially parallel and perpendicular walls 134 can include curved or angled corners 138 configured to assist with flow through the exhaust chamber 130.

Figure 8A:
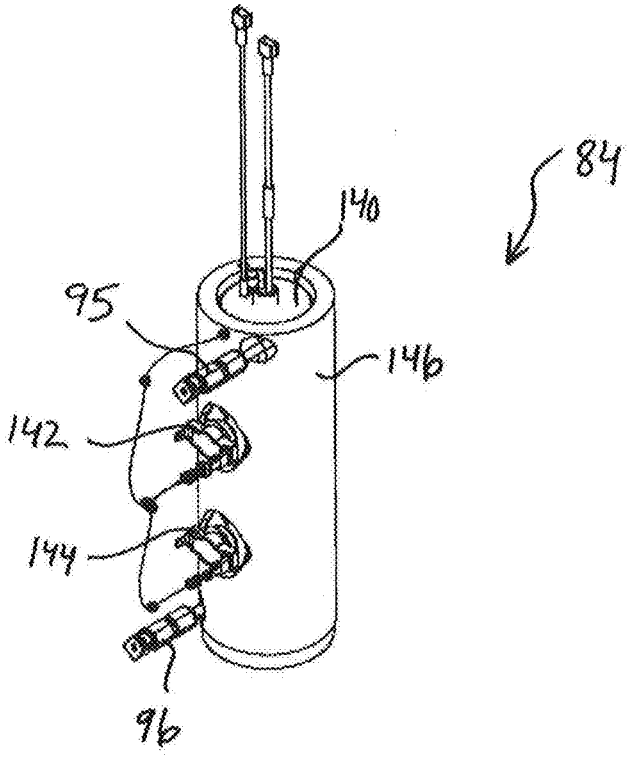
FIGS. 8A, 8B, 8C, and 8D are perspective, front, side, and exploded views, respectively, of a heating unit of the vacuum extraction apparatus.
Figure 8B:
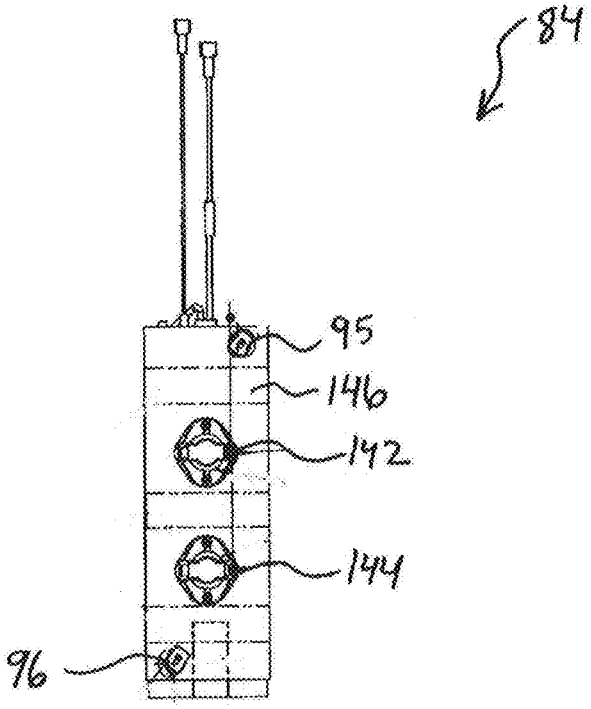
Figure 8C:
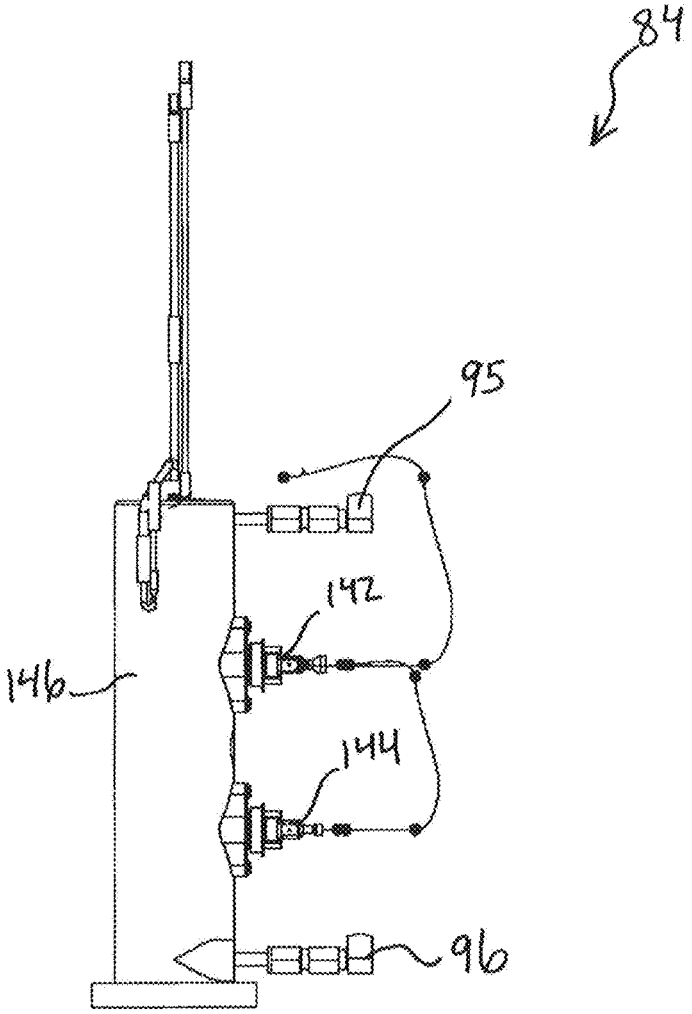
Figure 8D:
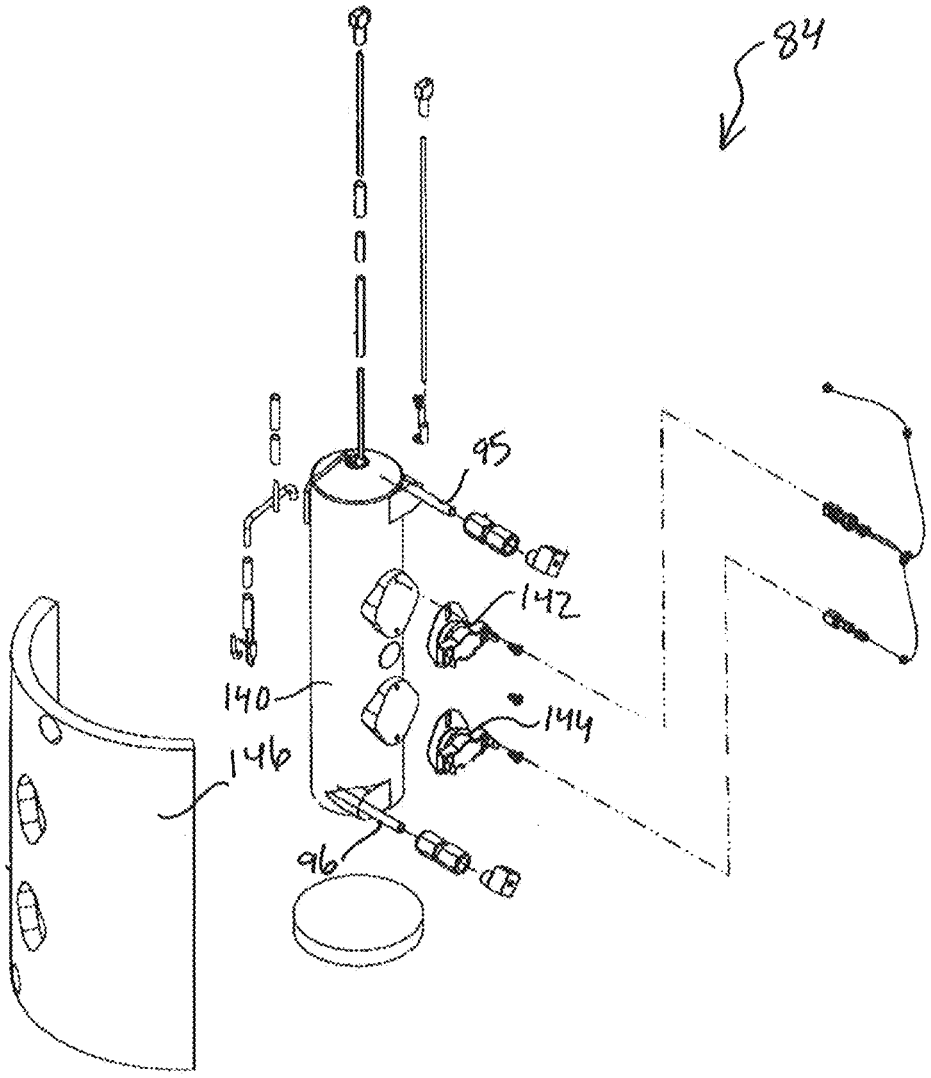

FIGS. 8A, 8B, and 8C are perspective, front, and side views of the heating unit 84 removed from the vacuum extraction apparatus 20. FIG. 8D is an exploded perspective view of the heating unit 84 illustrating the connection of the various components. As illustrated in FIGS. 8A-8D, the heating unit 84 can include a main body 140, a first thermostat device 142, and a second thermostat device 144. In an example, the heating unit inlet 95 can be positioned adjacent to the first thermostat device 142, and the heating unit outlet 96 can be positioned adjacent to the second thermostat device 144. However, the positions of the first and second thermostat devices 142 and 144 can be interchanged without departing from the intended scope of the present application. Further, an insulating heater wrap 146 can be wrapped around at least a portion of the main body 140 to help prevent heat loss from the main body 140 and maintain a desired level of efficiency. The heating wrap 146 can be formed from, for example, a foam material.

Figure 9:
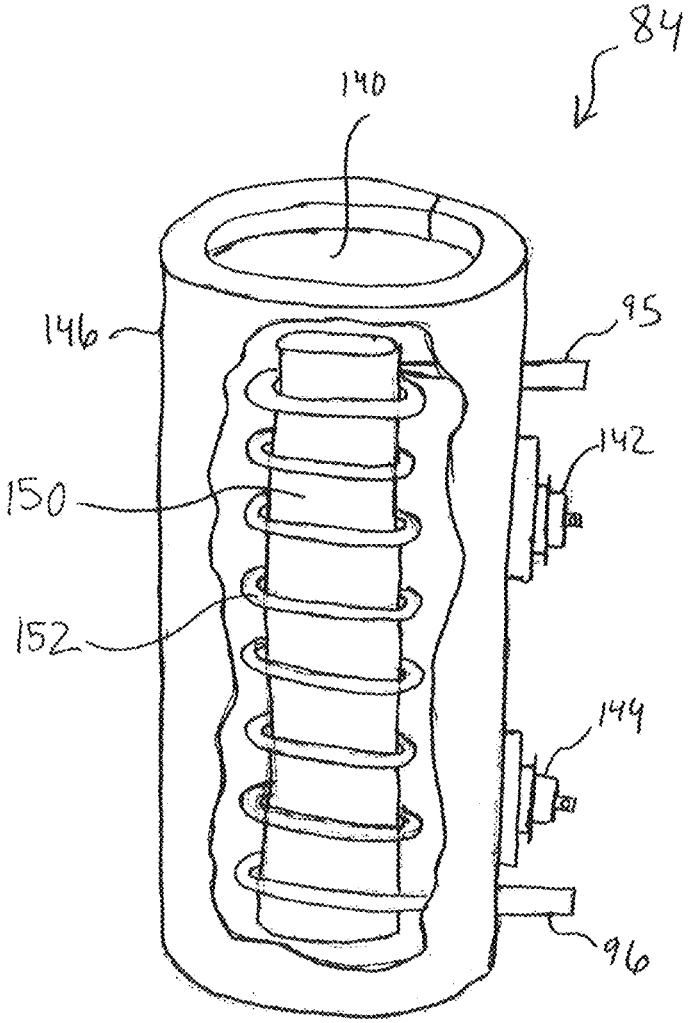
FIG. 9 is a partial cutaway view of the heating unit illustrating exemplary internal components thereof.

FIG. 9 is a partial cutaway view of the heating unit 84 illustrating exemplary internal components. As shown in FIG. 9, an electric core 150 can be positioned within the main body 140. A coil 152 carrying the cleaning fluid 146 can wrap around the electric core 150 such that heat from the core 150 is transferred into the cleaning fluid 46 in the coil 152 to heat the fluid. The electric core 150 can be safely maintained within the main body 140 such that operators are protected. Further, the electric core 150 can be formed from, for example, an aluminum casting or the like.

In an example, the control panel 56 can provide the option to select between two or more cleaning fluid temperatures, such as with a low temperature selection switch and a high temperature selection switch. With reference to FIGS. 8A-8D and FIG. 9, the low temperature selection switch can be operably coupled to the first thermostat device 142, and the high temperature selection switch can be operably coupled to the second thermostat device 144. The low temperature selection switch and the high temperature selection switch can be separate switches, or can be provided in a single multi-position switch.

The heating unit 84 can use any suitable type of thermostat device. In an example, the first and second thermostat devices 142 and 144 can be bi-metal, snap-action type thermostats, with the first thermostat device 142 being configured to substantially maintain the cleaning fluid 46 at a first, lower temperature, and the second thermostat device 144 being configured to substantially maintain the cleaning fluid 46 at a second, higher temperature. Particularly, the temperature of the cleaning fluid 46 can be indirectly controlled based upon a temperature of the electric core 150. In an example, when the bi-metallic element of the first thermostat device 142 senses a predefined lower temperature set-point, the bi-metallic element snaps open such that the electrical circuit is broken and power is prevented from flowing through the electric core 150. When the electric core 150 cools down, the bi-metallic element once again snaps closed, thereby completing an electrical circuit and causing power to once again flow to the electric core 150 and heat the cleaning fluid 46. Consequently, the first thermostat device 142 can be configured to maintain the electric core 150, and thus the cleaning fluid 46, at a substantially constant temperature (or within a range of temperature values). The second thermostat device 144 can operate in a similar manner, but maintains the cleaning fluid 146 at a substantially constant higher temperature set-point. In an example, the first thermostat device 142 can be configured to maintain the cleaning fluid 46 at a temperature between about 150° F. and about 180° F., and the second thermostat device 144 can be configured to maintain the cleaning fluid 46 at a temperature between about 180° F. and about 230°

F. However, numerous other temperatures are also contemplated and within the intended scope of the present application.

As appreciated by those skilled in the art, bi-metal thermostats can provide a simple yet effective means for selecting and maintaining the temperature of the cleaning fluid 46 at a desired level.

Although a heating unit 84 having two thermostat devices is described and illustrated herein, any heating unit having one or more temperature control means can be used with the vacuum extraction apparatus 20 in accordance with the present application. Further, although the heating unit 84 has been described with reference to the vacuum extraction apparatus 20, the heating unit 84 can be used in numerous other types of devices and heating applications that require the ability to set temperature at discrete levels as those skilled in the art will appreciate. Thus, the heating unit 84 of the present application is not limited to use with a vacuum extraction apparatus.

Further, although the vacuum extraction apparatus 20 has been described as including the heating unit 84, the heating unit 84 can also be omitted. In an example, heated cleaning fluid can be poured directly into the clean fluid tank 26 for distribution through the fluid port 44.

Figure 10:
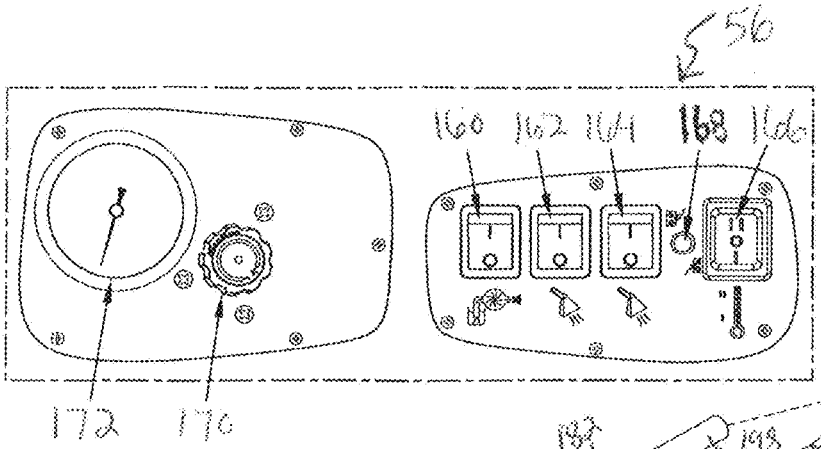
FIG. 10 is a top view of a control panel associated with the vacuum extraction apparatus.

FIG. 10 is a top view of the control panel 56 depicted in, for example, FIGS. 1 and 2. As shown in FIG. 10, the control panel 56 can include a solution pump switch 160 configured to turn the pump 80 on and off, a first vacuum switch 162 configured to turn the first vacuum unit 82A on and off, a second vacuum switch 164 configured to turn the second vacuum unit 82B on and off, a heat switch 166 configured to control the temperature of the cleaning fluid 46 via the heating unit 84, and a circuit indicator 168 that, when illuminated, indicates that the first electrical cord 40 and the second electrical cord 42 are on a separate circuit. In an example, the heat switch 166 can be a three-position switch including a "low temperature" position (position "I" in FIG. 10), a "heater off" position (position "O" in FIG. 10), and a "high temperature" position (position "II" in FIG. 10). Alternatively, separate heat switches can be provided for the "low temperature" and "high temperature" settings.

As shown in FIG. 10, the control panel 56 can further include a pressure adjustment knob 170 and a pressure gauge 172. In an example, rotating the pressure adjustment knob 170 in a clockwise direction can increase the pressure of the cleaning fluid 46, and rotating the pressure adjustment knob 170 in a counterclockwise direction can decrease the pressure of the cleaning fluid 46. The current pressure of the cleaning fluid 46 can be displayed on the pressure gauge 172.

The first and second vacuum units 82A and 82B and the heating unit 84 have been described as being controllable via separate buttons, switches, or the like merely for purposes of example and not limitation. In an example, a single switch, button, or the like can be configured to control both the "suction power" and the fluid temperature simultaneously, such as by energizing both the first and second vacuum units 82A and 82B and heating the cleaning fluid to a high temperature setpoint with a single selection by the operator. Further, in an example, actuation of another switch, button, or the like can result in only one of the first and second vacuum units 82A and 82B being energized, and the heating unit 84 set to a low temperature setpoint.

Figure 11:
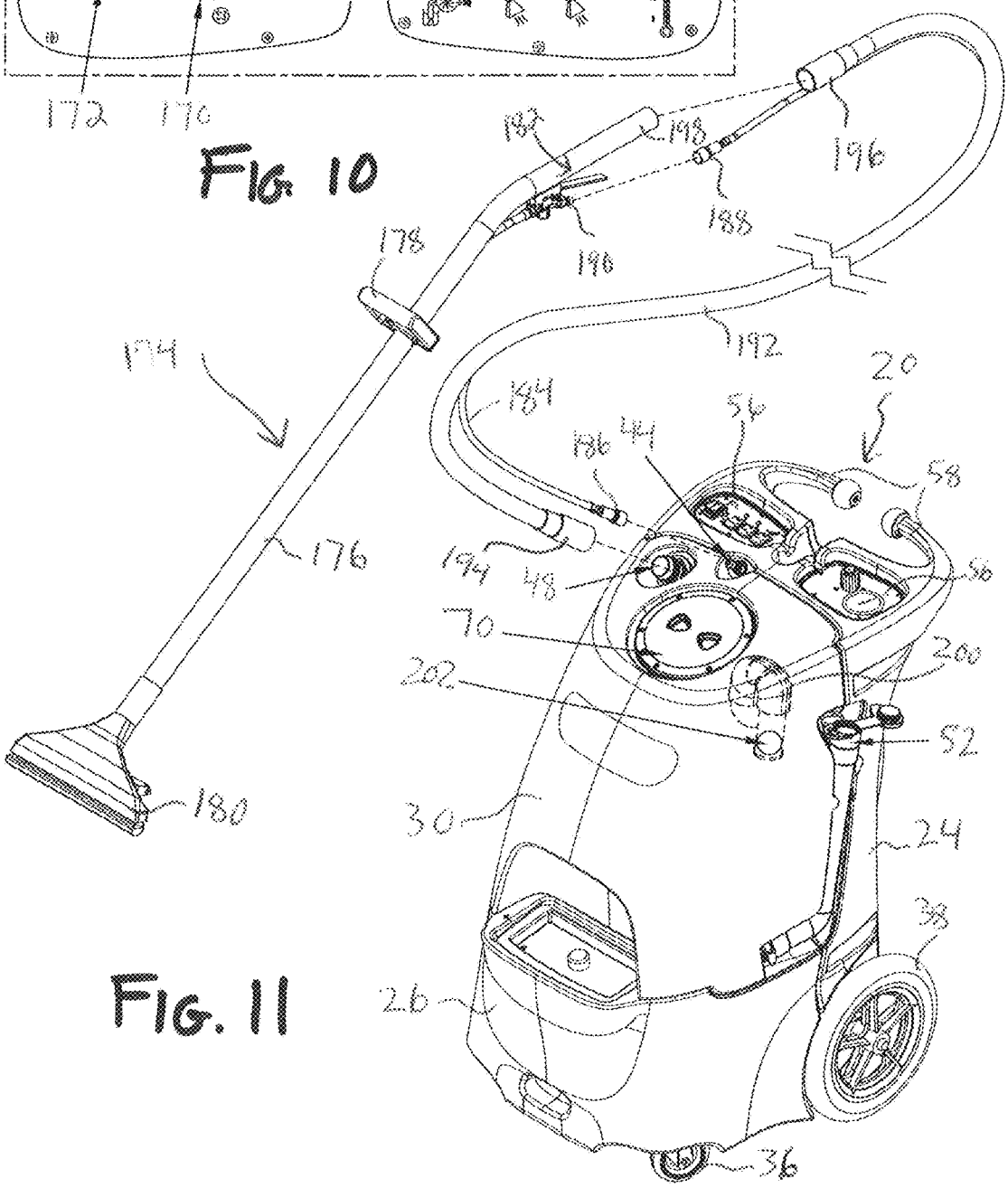
FIG. 11 is a perspective view showing how a cleaning wand can be operably coupled to the vacuum extraction apparatus.

FIG. 11 is a perspective view showing how a cleaning wand 174 can be operably coupled to the vacuum extraction apparatus 20. The cleaning wand 174 can include a main body 176 having a handle 178, a cleaning head 180, and operator controls 182. A solution hose 184 can be provided that includes a first end 186 configured to be coupled to the fluid delivery port 44 of the base 24 and a second end 188 configured to be coupled to an inlet port 190 of the cleaning wand 174. A vacuum hose 192 can also be provided that includes a first end 194 configured to be coupled to the inlet 48 of the recovery tank 30 and a second end 196 configured to be coupled to a vacuum inlet 198 of the cleaning wand.

As shown in FIG. 11, the recovery tank can include a passageway 200 having a shutoff float 202 that is configured to block the suction from the vacuum system (i.e., first vacuum unit 82A and/or second vacuum unit 82B) when the recovery tank 30 is substantially full. When the shutoff float 202 closes, the cleaning fluid 46 can continue to be dispensed from the cleaning wand 174, but the cleaning wand 174 will not pick up any substantial amount of "dirty" fluid from the floor surface. In an example, the operator can be alerted to the full recovery tank 30 by a sudden change in the sound of the first vacuum unit 82A and/or the second vacuum unit 82B when the shutoff float 202 closes. Emptying the recovery tank 30 can allow the shutoff float 202 to return to its normal, non-impeding position, and suction of "dirty" fluid through the cleaning head 180 can continue.

Although the subject matter of the present patent application has been described with reference to various embodiments, workers skilled in the art will recognize that changes can be made in form and detail without departing from the scope of the application.

What is claimed is:

1. A vacuum extraction apparatus, comprising:

a base having a front side, an opposing rear side, an upper end, and a lower end vertically spaced from the upper end of the base;

a tank assembly having a front side, an opposing rear side, an upper end, and a lower end vertically spaced from the upper end of the tank assembly, the tank assembly including a first tank defining a first fluid volume and a second tank defining a second fluid volume, wherein the tank assembly is rotatably coupled to the lower end of the base such that the vacuum extraction apparatus is movable between a closed position wherein the front side of the base is in contact with the rear side of the tank assembly and an open position wherein the front side of the base is spaced apart from the rear side of the tank assembly;

at least two transport wheels coupled to the lower end of the base;

a fluid pump coupled to the base and operable to draw fluid from the first tank and distribute the fluid to a fluid port; and one or more vacuum units coupled to the base and operable to decrease a pressure level within the second tank;

wherein at least a portion of the fluid pump is vertically spaced from the one or more vacuum units within a base chamber when the vacuum extraction apparatus is in a generally vertical operational position;

wherein both the first tank and the second tank are positioned forward of the front side of the base when the vacuum extraction apparatus is in the generally vertical operational position; and wherein the first fluid volume of the first tank is positioned above the second fluid volume of the second tank when the vacuum extraction apparatus is in the generally vertical operational position.

2. The vacuum extraction apparatus of claim 1, wherein the first tank is a clean fluid tank and the second tank is a recovery tank.

3. The vacuum extraction apparatus of claim 1, further comprising a heating unit operable to elevate a temperature of the fluid, the heating unit including one or more discrete temperature settings.

4. The vacuum extraction apparatus of claim 3, wherein the heating unit includes one or more bi-metal thermostat devices.

5. The vacuum extraction apparatus of claim 4, wherein the one or more bi-metal thermostat devices includes a first bi-metal thermostat device for substantially maintaining the fluid at a first temperature and a second bi-metal thermostat device for substantially maintaining the fluid at a second temperature.

6. The vacuum extraction apparatus of claim 5, wherein the first temperature is between about 150° F. and about 180° F., and wherein the second temperature is between about 180° F. and about 230° F.

7. The vacuum extraction apparatus of claim 3, wherein the heating unit includes a coil wrapped around an electric core, the coil configured to allow passage of the fluid therethrough.

8. The vacuum extraction apparatus of claim 7, wherein the coil and the electric core are at least partially surrounded by an insulating material.

9. The vacuum extraction apparatus of claim 1, wherein the base includes an air intake, and wherein the air intake includes an air intake cover configured to provide an indirect path for ambient air into the air intake.

10. The vacuum extraction apparatus of claim 1, wherein the one or more vacuum units comprise a first vacuum unit and a second vacuum unit, the first and second vacuum units configured to be individually or simultaneously operated to provide at least two distinct pressure levels within the second tank.

11. The vacuum extraction apparatus of claim 1, further comprising a handle extending away from the rear side of the base and positioned near the upper end of the base.

12. A vacuum extraction apparatus, comprising:

a base having a front side, an opposing rear side, a top side, a bottom side vertically spaced from the top side, and an interior defining a base chamber;

a tank assembly pivotally coupled to the base with a hinge, the tank assembly including a first tank defining a first fluid volume and a second tank defining a second fluid volume;

a fluid pump disposed within the base chamber and operable to draw fluid from the first tank and distribute the fluid to a fluid port;

a heating unit disposed within the base chamber and operable to elevate a temperature of the fluid;

one or more vacuum units disposed within the base chamber and operable to decrease a pressure level within the second tank, each of the one or more vacuum units including a vacuum motor intake extending from an air intake and providing a closed fluid path to the exterior of the vacuum extraction apparatus; and an exhaust chamber positioned adjacent to the bottom side of the base and including an exhaust chamber inlet and an exhaust chamber outlet, the exhaust chamber inlet in communication with the base such that during operation of the vacuum extraction apparatus, the exhaust chamber receives exhaust air from the one or more vacuum units and releases the exhaust air through the exhaust chamber outlet;

wherein, when the vacuum extraction apparatus is in a generally vertical operational position:

the first tank and the second tank are positioned forward of the front side of the base; and the first fluid volume of the first tank is positioned above the second fluid volume of the second tank.

13. The vacuum extraction apparatus of claim 12, wherein the exhaust chamber includes a series of chamber walls defining a generally serpentine path for the exhaust air.

14. The vacuum extraction apparatus of claim 13, wherein the series of chamber walls includes a series of substantially parallel and substantially perpendicular walls defining the generally serpentine path for the exhaust air.

15. The vacuum extraction apparatus of claim 14, wherein at least one adjacent pair of walls intersects to form a curved or angled corner.

16. The vacuum extraction apparatus of claim 13, wherein the series of chamber walls includes a series of curved walls defining the generally serpentine path for the exhaust air.

17. The vacuum extraction apparatus of claim 13, wherein the exhaust chamber is formed integral with the base.

18. The vacuum extraction apparatus of claim 17, wherein the exhaust chamber further includes an exhaust chamber cover configured to substantially enclose the chamber walls.

19. The vacuum extraction apparatus of claim 13, wherein the exhaust chamber outlet includes at least one curved wall configured to direct the exhaust air in a downward direction away from the base.

20. A vacuum extraction apparatus, comprising:

a base having a front side, an opposing rear side, an upper end, and a lower end vertically spaced from the upper end of the base;

a handle positioned near the upper end of the base and extending away from the rear side of the base;

a tank assembly pivotally coupled to the lower end of the base such that the vacuum extraction apparatus is movable between a closed position wherein the front side of the base is in contact with a rear side of the tank assembly and an open position wherein the front side of the base is spaced apart from the rear side of the tank assembly, the tank assembly including a first tank defining a first fluid volume and a second tank defining a second fluid volume;

a fluid pump operable to draw fluid from the first tank and distribute the fluid to a fluid port;

a heating unit operable to heat the fluid to a selectable temperature, the heating unit including at least a first bi-metal thermostat device for substantially maintaining the fluid at a first temperature and a second bi-metal thermostat device for substantially maintaining the fluid at a second temperature;

a vacuum system, including a first vacuum unit and a second vacuum unit, the first and second vacuum units configured to be individually or simultaneously operated to provide at least two distinct pressure levels within the second tank;

an exhaust chamber positioned adjacent to a bottom side of the base and configured to receive exhaust air from the vacuum system;

a first air intake spaced vertically above the exhaust chamber, a second air intake spaced vertically above the exhaust chamber;

a first vacuum motor intake extending from the first air intake and providing a closed fluid path to the exterior of the vacuum extraction apparatus; and a second vacuum motor intake extending from the second air intake and providing a closed fluid path to the exterior of the vacuum extraction apparatus;

wherein, when the vacuum extraction apparatus is in a generally vertical operational position:

the first tank and the second tank are positioned forward of the front side of the base; and the first fluid volume of the first tank is positioned above the second fluid volume of the second tank.

* * * * *